US005702543A

United States Patent [19]

Palumbo

[11] Patent Number: 5,702,543

[45] Date of Patent: Dec. 30, 1997

[54] THERMOMECHANICAL PROCESSING OF METALLIC MATERIALS

[76] Inventor: Gino Palumbo, 9 Tyler Pl., Etobicoke, Canada, M9R 1L8

[21] Appl. No.: 167,188

[22] Filed: Dec. 16, 1993

Related U.S. Application Data

[63] Continuation-in-part of Ser. No. 994,346, Dec. 21, 1992, abandoned.

[51] Int. Cl.[6] ..... C21D 9/08

[52] U.S. Cl. ..... 148/592; 148/610; 148/651; 148/676; 148/677

[58] Field of Search ..... 148/592, 610, 148/651, 676, 684, 677

[56] References Cited

U.S. PATENT DOCUMENTS

| | | | |
|---|---|---|---|
| 1,878,936 | 9/1932 | Legg | 148/684 |
| 1,911,023 | 5/1933 | Kelly | 148/684 |
| 2,184,498 | 12/1939 | Hudson | 148/593 |
| 2,237,244 | 3/1941 | Wilkins | 148/681 |
| 2,394,673 | 2/1946 | Edmunds | 148/684 |
| 3,046,166 | 7/1962 | Hartman | 148/684 |
| 3,788,902 | 1/1974 | Shapiro et al. | 148/684 |
| 3,841,921 | 10/1974 | Shapiro et al. | 148/684 |
| 3,855,012 | 12/1974 | Shapiro et al. | 148/681 |
| 3,867,209 | 2/1975 | Horiuchi et al. | 148/96 |
| 4,070,209 | 1/1978 | Usui | 148/591 |
| 4,354,882 | 10/1982 | Greer | 148/541 |
| 4,613,385 | 9/1986 | Thomas et al. | 148/599 |
| 4,832,756 | 5/1989 | Woodard et al. | 148/685 |
| 4,877,461 | 10/1989 | Smith et al. | 148/677 |
| 5,017,249 | 5/1991 | Smith et al. | 148/410 |
| 5,017,250 | 5/1991 | Ashok | 148/411 |
| 5,039,478 | 8/1991 | Sankaranarayanan | 420/469 |

FOREIGN PATENT DOCUMENTS

| | | | |
|---|---|---|---|
| 090 115A3 | 10/1983 | European Pat. Off. | C21D 8/00 |
| 500 377A1 | 8/1992 | European Pat. Off. | C22F 1/08 |
| 54-25493 | 8/1979 | Japan | 148/610 |
| 3-13529 | 1/1991 | Japan . | |
| 1124287 | 8/1968 | United Kingdom . | |
| 2027627 | 2/1980 | United Kingdom | 148/592 |

OTHER PUBLICATIONS

Patent Abstracts Of Japan, vol. 11, No. 229(C-436) 25 Jul. 1987 & JP,A,62 040 336 (Mitsubishi Metal Corp) 21 Feb. 1987.

Patent Abstracts Of Japan, vol. 10, No. 230 (C-365) 9 Aug. 1986 & JP,A,61 064 853 (Toshiba Corp) 3 Apr. 1986.

G. Palumbo et al, "On Annealing Twins and CSL Distributions in F.C.C. Polycrystals". Phys. Stat. Sol. a, 131 p. 425 (1992).

G. Palumbo et al.—"Grain Boundary Structure Control for Intergranular Stress—Corrosion Resistance" Mat. Res. Soc. Symp. Proc. Fol 238, p. 311 et sec. (1992).

G. Palumbo et al—"Grain Boundary Design and Control for Intergranular Stress–Corrosion Resistance"—Scripts Metallurgica et Materialia, vol. 25, pp. 1775–1780, (1991).

*Primary Examiner*—Sikyin Ip
*Attorney, Agent, or Firm*—Ridout & Maybee

[57] ABSTRACT

In the fabrication of components from a face centred cubic alloy, wherein the alloy is cold worked and annealed, the cold working is carried out in a number of separate steps, each step being followed by an annealing step. The resultant product has a grain size not exceeding 30 microns, a "special" grain boundary fraction not less than 60%, and major crystallographic texture intensities all being less than twice that of random values. The product has a greatly enhanced resistance to intergranular degradation and stress corrosion cracking, and possesses highly isotropic bulk properties.

10 Claims, 4 Drawing Sheets

THERMOMECHANICAL PROCESSING OF METALLIC MATERIALS

CROSS-REFERENCE TO RELATED APPLICATION

This application is a continuation-in-part of application No. 07/994,346 filed Dec. 21, 1992, now abandoned and entitled "Thermomechanical Processing of Metallic Materials".

FIELD OF THE INVENTION

This invention relates generally to the fabrication of alloy components wherein the alloy is subjected to cold working and annealing during the fabrication process. The invention is particularly addressed to the problem of intergranular degradation and fracture in articles formed of austenitic stainless alloys. Such articles include, for example, steam generator tubes of nuclear power plants.

BACKGROUND OF THE INVENTION

Intergranular degradation and fracture are among the commonest failure modes which currently compromise nuclear steam generator reliability. Previous attempts to alleviate susceptibility to intergranular failure have primarily involved the control of the alloy chemistry and the operating environment. However, the known source of the problem, the grain boundaries in the alloy, has largely been ignored.

The inventor and others have conducted studies to evaluate the viability of improving the resistance of conventional iron and nickel-based austenitic alloys, i.e. austenitic stainless alloys, to intergranular stress corrosion cracking (IGSCC) through the utilization of grain boundary design and control processing considerations. (See G. Palumbo, P. J. King, K. T. Aust, U. Erb and P. C. Lichtenberger, "Grain Boundary Design and Control for Intergranular Stress Corrosion Resistance", Scripta Metallurgica et Materialia, 25, 1775 (1991)). The study produced a geometric model of crack propagation through active intergranular paths, and the model was used to evaluate the potential effects of "special" grain boundary fraction and average grain size on IGSCC susceptibility in equiaxed polycrystalline materials. The geometric model indicated that bulk IGSCC resistance can be achieved when a relatively small fraction of the grain boundaries are not susceptible to stress corrosion. Decreasing grain size is shown to increase resistance to IGSCC, but only under conditions in which non-susceptible grain boundaries are present in the distribution. The model, which is generally applicable to all bulk polycrystal properties which are dependent on the presence of active intergranular paths, showed the importance of grain boundary design and control, through material processing, and showed that resistance to IGSCC could be enhanced by moderately increasing the number of "special" grain boundaries in the grain boundary distribution of conventional polycrystalline alloys.

"Special" grain boundaries are described crystallographically by the well established CSL (coincidence site lattice) model of interface structure as those lying within $\Delta\theta$ of $\Sigma$, where $\Sigma \leqq 29$, and $\Delta\theta \leqq 15\Sigma^{-1/2}$ [see Kronberg and Wilson, Trans.Met. Soc. A.I.M.E., 1.85, 501 (1949) and Brandon, Acta Metall., 34, 1479 (1966)].

SUMMARY OF THE INVENTION

The present invention provides a mill processing methodology for increasing the "special" grain boundary fraction, and commensurately rendering face-centered cubic alloys highly resistant to intergranular degradation. The mill process described also yields a highly random distribution of crystallite orientations leading to isotropic bulk properties (e.g., mechanical strength) in the final product. Comprehended within the term "face-centered cubic alloy" as used in this specification are those iron-, nickel- and copper-based alloys in which the principal metallurgical phase (>50% of volume) possesses a face-centered cubic crystalline structure at engineering application temperatures and pressures. This class of materials includes all chromium-bearing iron- or nickel-based austenitic alloys.

According to one aspect of the present invention, the method of enhancing the resistance of an austenitic stainless alloy to intergranular degradation comprises cold working the alloy to achieve a forming reduction less than the total forming reduction required, and usually well below the limits imposed by work hardening, annealing the partially reduced alloy at a temperature sufficient to effect recrystallization without excessive grain growth, and repeating the cold working and annealing steps cyclically until the total forming reduction required is achieved. The resultant product, in addition to an enhanced "special" grain boundary fraction and corresponding intergranular degradation resistance, also possesses an enhanced resistance to "sensitization". Sensitization refers to the process by which chromium carbides are precipitated at grain boundaries when an austenitic stainless alloy is subjected to temperatures in the range 500° C.–850° C. (e.g. during welding), resulting in depletion of the alloyed chromium and enhanced susceptibility to various forms of intergranular degradation.

By "cold working" is meant working at a temperature substantially below the recrystallization temperature of the alloy, at which the alloy will be subjected to plastic flow. This will generally be room temperature in the case of austenitic stainless alloys, but in certain circumstances the cold working temperature may be substantially higher (i.e. warm working) to assist plastic flow of the alloy.

By "forming reduction" is meant the ratio of reduction in cross-sectional area of the workpiece to the original cross-sectional area, expressed as a percentage or fraction. It is preferred that the forming reduction applied during each working step be in the range 5%–30%, i.e.0.05–0.30.

According to another aspect of the invention, in a fabricated article of formed face-centered cubic alloy having an enhanced resistance to intergranular degradation, the alloy has a grain size not exceeding 30 microns and a special grain boundary fraction not less than 60%.

BRIEF DESCRIPTION OF THE DRAWINGS

Preferred embodiments of the invention are described in detail below with reference to the drawings, in which.

PREFERRED EMBODIMENTS OF THE INVENTION

Figure 1:
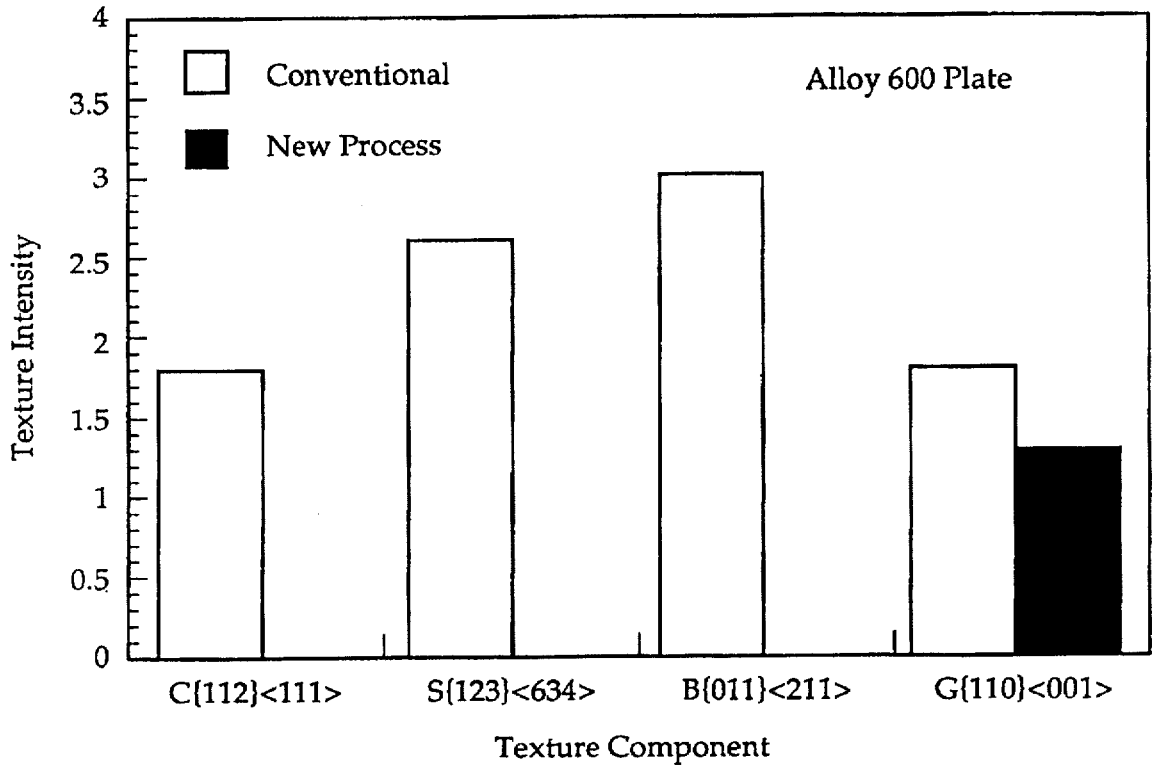
FIG. 1 is a schematic representation of differences in texture components and in intensities determined by X-ray diffraction analysis between samples of UNS N06600 plate processed conventionally and by the process of the present invention.

The method of the invention is especially applicable to the thermomechanical processing of austenitic stainless alloys, such as stainless steels and nickel- based alloys, including the alloys identified by the Unified Numbering System as N06600, N06690, N08800 and S30400. Such alloys comprise chromium-bearing, iron-based and nickel-based face-centered cubic alloys. The typical chemical composition of Alloy N06600, for example is shown in Table 1.

TABLE 1

| Element | % By Weight |
|---|---|
| Al | ND* |
| C | 0.06 |
| Cr | 15.74 |
| Cu | 0.26 |
| Fe | 9.09 |
| Mn | 0.36 |
| Mo | ND |
| Ni | 74.31 |
| P | ND |
| S | 0.002 |
| Si | 0.18 |
| Ti | ND |

*not determined

In the fabrication of nuclear steam generator tubing by thermomechanical processing according to the present invention a tubular blank of the appropriate alloy, for example Alloy N06600, is cold drawn and thereafter annealed. The conventional practice is to draw the tubing to the required shape in usually one step, and then anneal it, so as to minimize the number of processing steps. However, as is well known, the product is susceptible to intergranular * not determined degradation. Intergranular degradation is herein defined as all grain boundary related processes which can compromise performance and structural integrity of the tubing, including intergranular corrosion, intergranular cracking, intergranular stress corrosion cracking, intergranular embrittlement and stress-assisted intergranular corrosion.

In contrast to current mill practice, which seeks to optimize the process by minimizing the number of processing steps, the method of the present invention seeks to apply a sufficient number of steps to yield an optimum microstructure. The principle of the method is based on the inventor's discovery that selective recrystallization induced at the most highly defective grain boundary sites in the microstructure of the alloy results in a high probability of continual replacement of high energy disordered grain boundaries with those having greater atomic order approaching that of the crystal lattice itself. The aim should be to limit the grain size to 30 microns or less and achieve a "special" grain boundary fraction of at least 60%, without imposing strong preferred crystallographic orientations in the material which could lead to anisotropy in other bulk material properties.

In the method of fabricating the tubing according to the present invention, the drawing of the tube is conducted in separate steps, each followed by an annealing step. In the present example the blank is first drawn to achieve a forming reduction which is between 5% and 30%, and then the partially formed product is annealed in a furnace at a temperature in the range 900°–1050° C. The furnace residence time should be between 2 and 10 minutes. The temperature range is selected to ensure that recrystallization is effected without excessive grain growth, that is to say, so that the average grain size will not exceed 30 μm. This average grain size would correspond to a minimum ASTM Grain Size Number (G) of 7. The product is preferably annealed in an inert atmosphere, in this example argon, or otherwise in a reducing atmosphere.

After the annealing step the partially formed product is again cold drawn to achieve a further forming reduction between 5% and 30% and is again annealed as before. These steps are repeated until the required forming reduction is achieved.

There must be at least three cold drawing/annealing cycles to produce tubing having the required properties. Ideally the number of cycles should be between 3 and 7, there being little purpose in increasing the number of cycles beyond 7 since further cycles add but little to the fraction of resulting "special" grain boundaries. It will be noted that the amount of forming reduction per drawing step is given by $$(1-r_t)=(1-r_i)^n$$

where $r_i$ is the amount of forming reduction per step, $r_t$ is the total forming reduction required, n is the number of steps, i.e. recrystallization steps.

The cold drawing of the tubing should be carried out at a temperature sufficient for inducing the required plastic flow. In the case of Alloy 600 and other alloys of this type, room temperature is usually sufficient. However, there is no reason why the temperature should not be well above room temperature.

A specific example of a room temperature draw schedule according to the invention as applied to UNS N06600 seamless tubing is given in the following Table 1. The total (i.e. cumulative) forming reduction which was required for the article in this example was 68.5%. Processing according to the present invention involves annealing the tubing for three minutes at 1000° C. between each forming step. This stands in contrast to the conventional process which applies the full 68.5% forming reduction prior to annealing for three minutes at 1000° C.

TABLE 2

| STEP | OUTSIDE DIAMETER, mm | WALL THICKNESS mm | CROSS SECTIONAL AREA, mm² | % RA/ step |
|---|---|---|---|---|
| Starting Dimensions | 25.4 | 1.65 | 123.1 | — |
| 1 | 22.0 | 1.55 | 99.6 | 19.8 |
| 2 | 19.0 | 1.45 | 80.0 | 19.7 |
| 3 | 16.6 | 1.32 | 63.4 | 20.8 |
| 4 | 15.2 | 1.14 | 50.3 | 20.6 |
| 5 | 12.8 | 1.05 | 38.8 | 23.0 |

In Table 2 above, % RA/step refers to the percentage reduction in cross-sectional area for each of the five forming steps of the process. The cumulative forming reduction of $r_t$=68.5% is given by the aforementioned formula relating $r_t$ to the amount of forming reduction per step, $r_i$ and n, the total number of recrystallization steps.

In the resultant product, the alloy is found to have a minimized grain size, not exceeding 30 microns, and a "special" grain boundary fraction of at least 60%.

The above example refers particularly to the important application of fabricating nuclear steam generator tubing in which the material of the end product has a grain size not exceeding 30 microns and a special grain boundary fraction of at least 60%, imparting desirable resistance to intergranular degradation. However, the method described is generally applicable to the enhancement of resistance to intergranular degradation in Fe—Ni—and Cu -based face-centered cubic alloys which are subjected to forming and annealing in fabricating processes.

Thus, in the fabrication of other Fe-, Ni-, and Cu- based face-centered cubic alloy products by rolling, drawing, or otherwise forming, wherein a blank is rolled, drawn or formed to the required forming reduction and then annealed, the microstructure of the alloy can be greatly improved to ensure the structural integrity of the product by employing a sequence of cold forming and annealing cycles in the manner described above.

In Table 3 below, two examples, tubing and plate, are given for comparing the grain boundary distributions in alloy UNS N06600 arising from "conventional process" (that is, one or two intermediate annealing steps) and the present "New Process" which involves multiple processing steps (≧3):

TABLE 3

| Material: | UNS N06600 Tubing-Conventional Process | UNS N06600 Tubing-New Process | UNS N06600 Plate-Conventional Process | UNS N06600 Plate-New Process |
|---|---|---|---|---|
| Total No: | 105 | 96 | 111 | 102 |
| Σ1 | 1 | 0 | 4 | 2 |
| Σ3 | 34 | 48 | 26 | 47 |
| Σ5 | 2 | 1 | 0 | 0 |
| Σ7 | 1 | 1 | 0 | 1 |
| Σ9 | 2 | 13 | 7 | 10 |
| Σ11 | 1 | 1 | 0 | 2 |
| Σ13 | 0 | 1 | 2 | 0 |
| Σ15 | 3 | 1 | 0 | 0 |
| Σ17 | 1 | 0 | 0 | 0 |
| Σ19 | 1 | 0 | 1 | 0 |
| Σ21 | 1 | 1 | 0 | 2 |
| Σ23 | 0 | 0 | 0 | 0 |
| Σ25 | 1 | 0 | 1 | 1 |
| Σ27 | 3 | 7 | 0 | 7 |
| Σ29 | 0 | 0 | 0 | 0 |
| Σ > 29 (General) | 54 | 22 | 70 | 30 |
| % Special (Σ ≦ 29) | 48.6% | 77.1% | 36.9% | 70.6% |

To afford a basis for comparison, the total forming reduction for tube processing (columns 2 and 3 of Table 3) and plate processing (columns 4 and 5 of Table 3) is again 68.5% in each case. In the conventional process, that degree of total forming reduction has been achieved in one single step with a final anneal at 1000° C. for three minutes and, in the new process, in five sequential steps involving 20% forming reduction per step, with each step followed by annealing for three minutes at 1000° C. The numerical entries are grain boundary character distributions Σ1, Σ3 etc. determined by Kikuchi diffraction pattern analysis in a scanning electron microscope, as discussed in v. Randle, "Microtexture Determination and its applications", Inst. of Materials, 1992. (Great Britain). The special grain boundary fraction for the conventionally processed materials is 48.6% for tubing and 36.9% for plate, by way of contrast with respective values of 77.1% and 70.6% for materials treated by the new forming process.

As illustrated in FIG. 1, the randomization of texture by processing according to the present invention leads to wrought products having highly uniform bulk properties. FIG. 1 shows in bar graph form the differences in texture components and intensities determined by X-ray diffraction analysis between UNS N06600 plate processed conventionally (single 68.5% forming reduction followed by a single 3 minute annealing step at 1000° C.) and like material treated according to the new process (68.5% cumulative forming reduction using 5 reduction steps of 20% intermediate annealing for 3 minutes at 1000° C.).

The major texture components typically observed in face-centered cubic materials are virtually all eliminated with the new process; the exception being the Goss texture [110] <001> which persists at just above that expected in a random distribution (i.e., texture intensity of 1). The new process thus yields materials having a highly desirable isotropic character.

Figure 2:
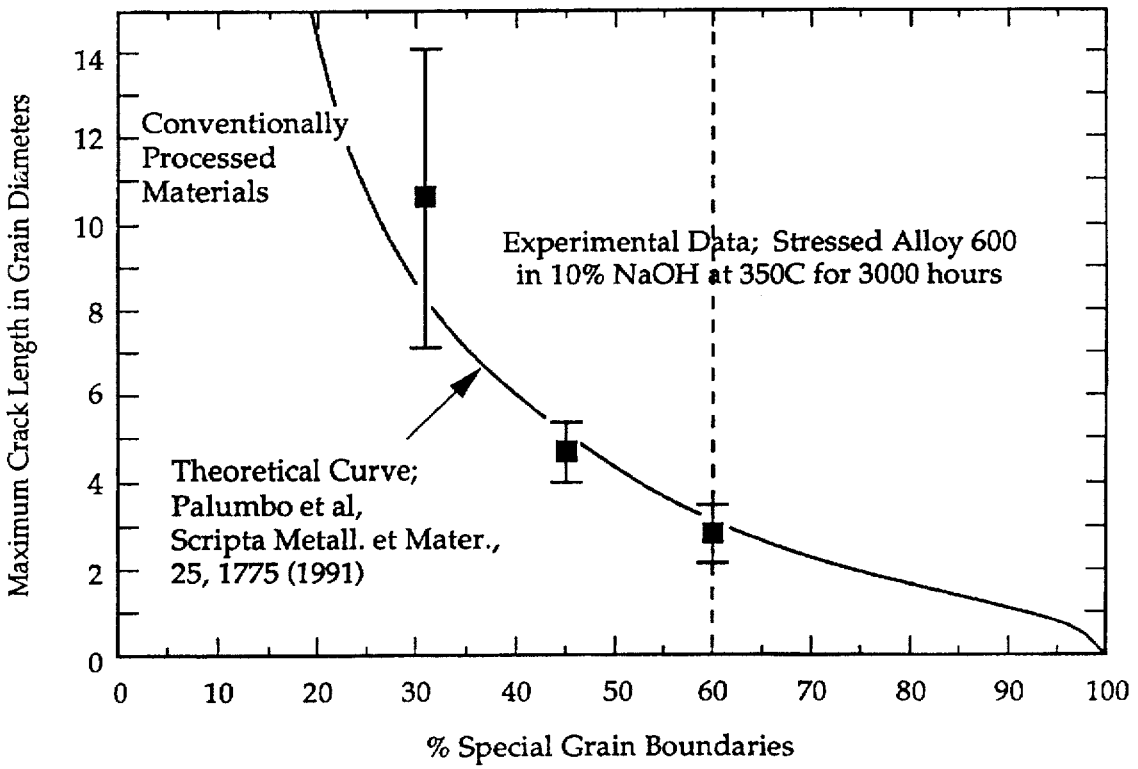
FIG. 2 is a graphical comparison of the theoretically predicted and experimentally determined stress corrosion cracking performance of stressed UNS N06600 C-rings.

As illustrated in FIG. 2, wrought products subjected to the process of the present invention possess an extremely high resistance to intergranular stress corrosion cracking relative to their conventionally processed counterparts. The graph of FIG. 2 summarizes theoretical and experimental stress corrosion cracking performance as it is affected by the population of "special" grain boundaries in the material. The experimental results are for UNS N06600 C-rings stressed to 0.4% maximum strain and exposed to a 10% sodium hydroxide solution at 350° C. for 3000 hours. The dashed line denotes the minimum special grain boundary fraction of 60% for fabricated articles according to the present invention.

Figure 3:
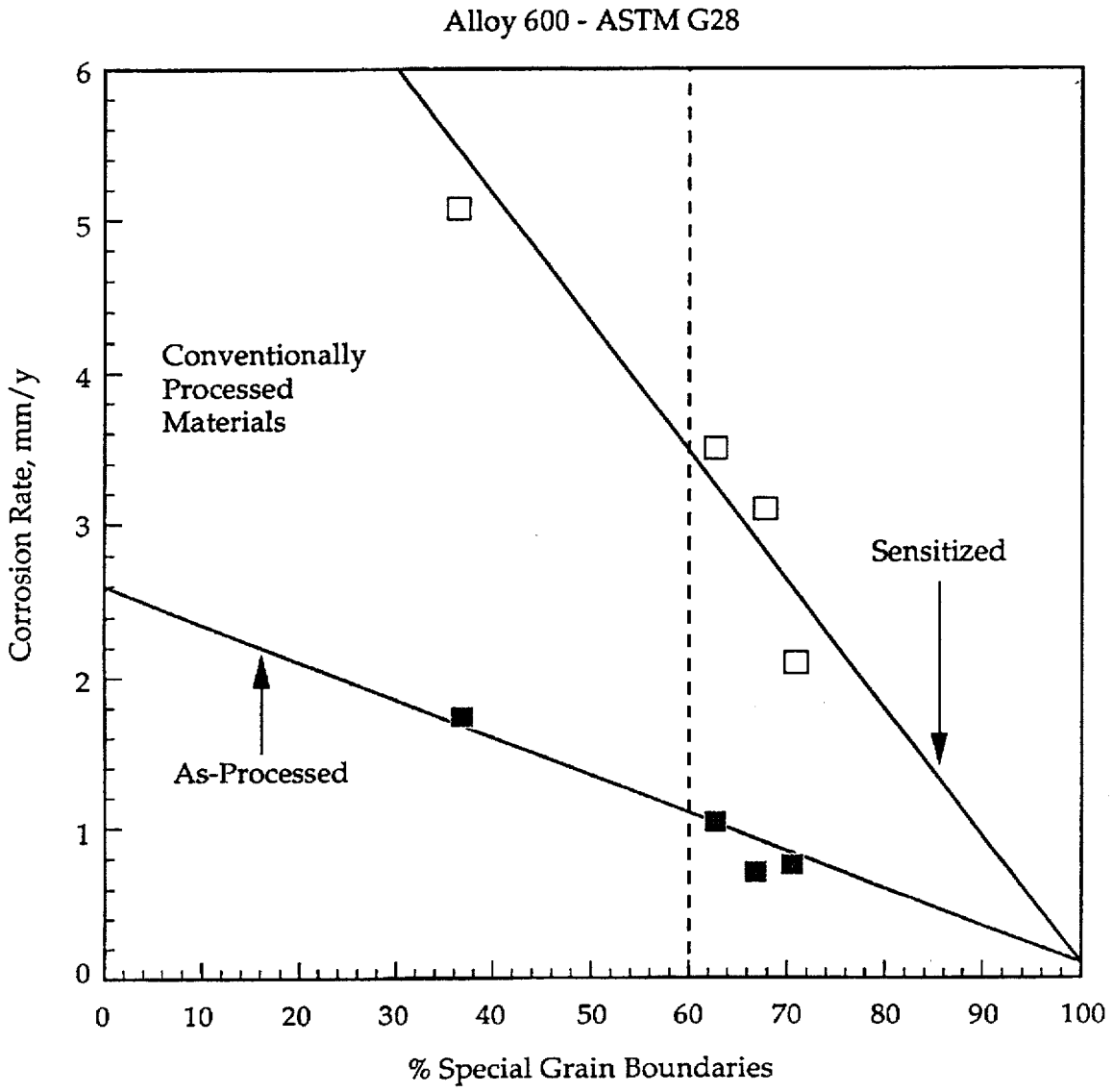
FIG. 3 is a graphical comparison between conventionally worked UNS N06600 plates and like components subjected to the process of the present invention, showing improved resistance to corrosion resulting from a greater percentage of special grain boundaries.

In addition to displaying a significantly enhanced resistance to intergranular corrosion in the as-processed mill annealed condition, wrought stainless alloys according to the present invention also possess a very high resistance to sensitization. This resistance to carbide precipitation and consequent chromium depletion, which arises from the intrinsic character of the large population of special grain boundaries, greatly simplifies welding and post-weld procedures and renders the alloys well-suited for service applications in which temperatures in the range of 500° C. to 850° C. may be experienced. FIG. 3 summarizes the effect of special grain boundary fraction on the intergranular corrosion resistance of UNS N06600 plates as assessed by 72-hour testing in accordance with ASTM G28 ("Detecting Susceptibility To Intergranular Attach in Wrought Nickel-Rich, Chromium Bearing Alloys").

As shown in FIG. 3, materials produced using the new process (in which the special grain boundary fraction exceeds 60%) display significantly reduced corrosion rates over those produced using conventional processing methods. Furthermore, the application of a sensitization heat treatment (i.e. 600° C. for two hours) to render the materials more susceptible to intergranular corrosion by inducing the precipitation of grain boundary chromium carbides, has a far lesser detrimental affect on materials having high special boundary fractions, i.e. those produced according to the process of the present invention.

Figure 4:
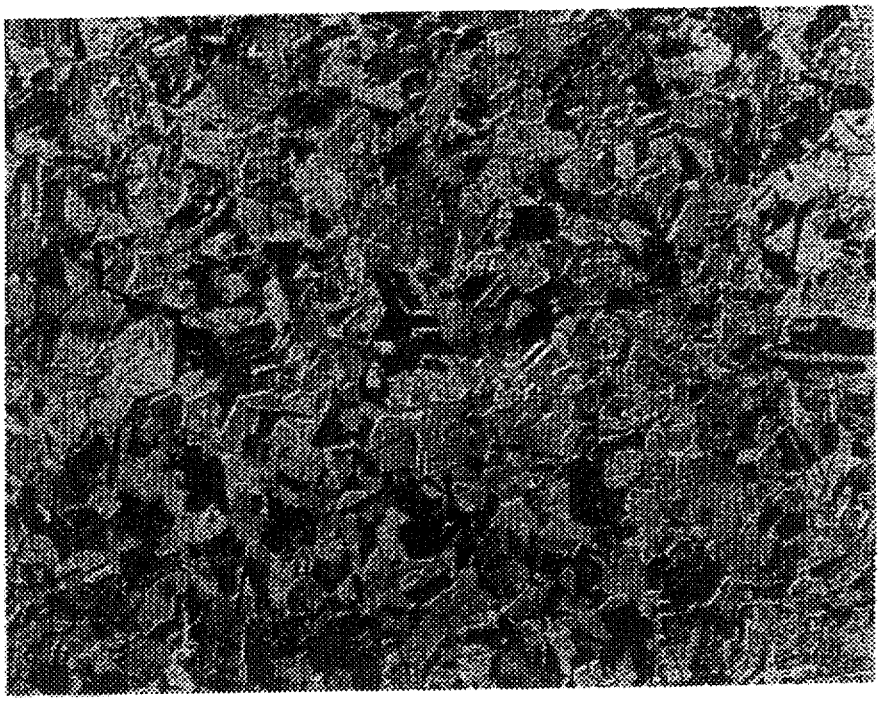
FIG. 4 is an optical photomicrograph of a section of UNS N06600 plate produced according to the process of the invention.

The high special boundary fraction exhibited in a UNS N06600 plate which has been produced using the process of the invention may be directly visually appreciated from FIG. 4, an optical photomicrograph of a Section of such plate (210×magnification). The good "fit" of component crystallite boundaries is evident by the high frequence of annealing twins, which appear as straight boundary lengths intersecting other boundaries at right angles.

It should be finally pointed out that, although the method of the present invention differs from conventional mill practice which seeks to minimize the number of forming and annealing steps, it is otherwise perfectly compatible with existing mill practice in that it does not call for changes in the equipment used.

I claim:

1. In the fabrication of articles from an austenitic stainless, iron-based or nickel-based face-centered cubic alloy wherein the alloy is subjected to cold working and annealing steps which are effective to produce recrystallization, the improvement which comprises selecting the number of said cold working and annealing steps so that said alloy is subjected to at least three cold working and annealing cycles to produce a special grain boundary fraction of at least 60%; each said cycle consisting of i) a cold working step in which the alloy is subjected to a forming reduction of up to 30%, and ii) an annealing step in which the alloy obtained from the cold working step is annealed at a temperature in the range of 900°–1050° C. for a time of 2–10 minutes.

2. A method according to claim 1, in which each cold working step is a cold drawing step.

3. A method according to claim 1, in which each cold working step is a cold rolling step.

4. A method according to claim 1, in which the annealing steps are conducted in an inert or a reducing atmosphere.

5. A method according to claim 1, in which the alloy is selected from the group consisting of N06600, N06690, N08800 and S30400.

6. A method according to claim 1 wherein the amount of forming reduction of each cold working step is determined by the equation $(1-r_t)=(1-r_i)^n$, wherein $r_i$ is the forming reduction of each cold working step, $r_t$ is the total desired forming reduction and n is the total number of cold working and annealing steps with the proviso that n equals at least 3.

7. The method of claim 1, wherein the forming reduction is between 5% and 30%.

8. In the fabrication of articles from a face-centered Fe- or Ni- based alloy wherein the alloy is subjected to cold working and annealing steps, said cold working and annealing steps being effective to produce recrystallization; the improvement which comprises randomizing grain texture and enhancing resistance of the alloy to intergranular degradation and increasing the special grain boundary fraction to at least 60% by performing said cold working and annealing steps so that said metal is subjected to:

i) a cold working step in which the alloy is subjected to a forming reduction of up to 30%;

ii) an annealing step in which the reduced alloy is annealed at a temperature in the range of 900°–1050° C. for a time of 2–10 minutes, and iii) repeating steps i) and ii) at least 3 times.

9. A method according to claim 8 wherein the amount of the forming reduction for each cold working step is determined by the equation $(1-r_t)=(1-r_i)^n$, wherein $r_i$ is the forming reduction of each cold working step, $r_t$ is the total desired forming reduction and n is the total number of cold working and annealing steps with the proviso that n equals at least 3.

10. The method of claim 8 wherein the forming reduction is between 5% and 30%.

* * * * *